United States Patent [19]

Sakuranaka et al.

[11] Patent Number: 4,530,330

[45] Date of Patent: Jul. 23, 1985

[54] DISTRIBUTION TYPE FUEL INJECTION PUMP

[75] Inventors: Toru Sakuranaka; Hachiro Aoki, both of Higashi-Matsuyama, Japan

[73] Assignee: Diesel Kiki Co., Ltd., Tokyo, Japan

[21] Appl. No.: 546,305

[22] Filed: Oct. 28, 1983

[51] Int. Cl.[3] ..... F02M 41/00

[52] U.S. Cl. ..... 123/449; 123/503; 123/459; 123/179 L

[58] Field of Search ..... 123/449, 503, 459, 506, 123/511, 179 L, 387, 179 G; 417/282, 289, 294

[56] References Cited

U.S. PATENT DOCUMENTS 3,638,631 2/1972 Gheim ..... 123/179 L
4,407,253 10/1983 Bauer ..... 123/459

FOREIGN PATENT DOCUMENTS 102423 8/1979 Japan ..... 123/449
134222 10/1979 Japan ..... 123/449
126828 10/1979 Japan ..... 123/503
56631 4/1982 Japan ..... 123/449

*Primary Examiner*—Magdalen Y. C. Moy
*Attorney, Agent, or Firm*—Wenderoth, Lind & Ponack

[57] ABSTRACT

A distribution type fuel injection pump for preventing generation of a smoke after start while maintaining the characteristics of excess fuel starting device. An engaging member is mounted on a control sleeve for control of fuel, and a delay device for abutting on the engaging member and delaying the shifting of the control sleeve is provided, whereby the shifting of the control sleeve in the fuel increasing direction is delayed even if there is a rapid actuation of an accelerator pedal in a low speed rotation zone such as an idle rotation time which does not have the characteristics of the excess fuel starting device which does not result in the supply of excessive fuel thereby to prevent the generation of smoke.

8 Claims, 3 Drawing Figures

DISTRIBUTION TYPE FUEL INJECTION PUMP

BACKGROUND OF THE INVENTION

This invention relates to a distribution type fuel injection pump of the type which distributes the fuel under pressure by rotating and reciprocating a plunger.

The distribution type fuel injection pump has a construction as disclosed, for example, in U.S. Pat. No. 4,346,688, and the characteristic line of the revolutions per minute (r.p.m.) of the engine and the amount of the fuel injected is the characteristic illustrated with a thick line in FIG. 2, and when the engine is in a low speed rotation condition, the characteristic an excess fuel starting device begins to appear at the idle spring and the start spring, and the increased amount of fuel at start time occurs, and the start of the engine is arranged to be carried out easily.

However, the characteristic of an excess fuel starting device always functions when it reaches a value below a certain r.p.m. even after the engine is once started, and as shown in FIG. 2, when the accelerator pedal is shifted rapidly from an idle lever position (at idle time) to a full load lever position, the fuel is increased rapidly from A to B, resulting in the supply of an excessive amount of fuel, and the smoke starts to generated due to the deterioration of the air/fuel ratio. However, the elimination of the characteristic of the excess fuel starting device results in the deterioration in the engine starting property, which leads to lots of problems, and which does not become an effective trouble shooting means for the prevention of the smoke.

SUMMARY OF THE INVENTION

A primary object of this invention is to prevent the generation of smoke by delaying the control sleeve at the time of rapid acceleration from a low speed of rotation and preventing the generation of the excessive fuel condition without entering the characteristic zone of excess fuel starting device.

A second object of this invention is to arrange so that the delaying device is not used other than at the low speed of rotation.

A third object of this invention is to minimize the influence of the delay device with respect to the shifting of the control sleeve due to the excess fuel starting device.

BRIEF DESCRIPTION OF DRAWINGS

These objects are achieved by this invention, and an embodiment is illustrated by the attached drawings and the detailed, description of this invention. The invention is not limited to the details of the structure contained in the specification, but is limited only by the claims to be set forth here.

DETAILED DESCRIPTION OF THE INVENTION

Figure 1:
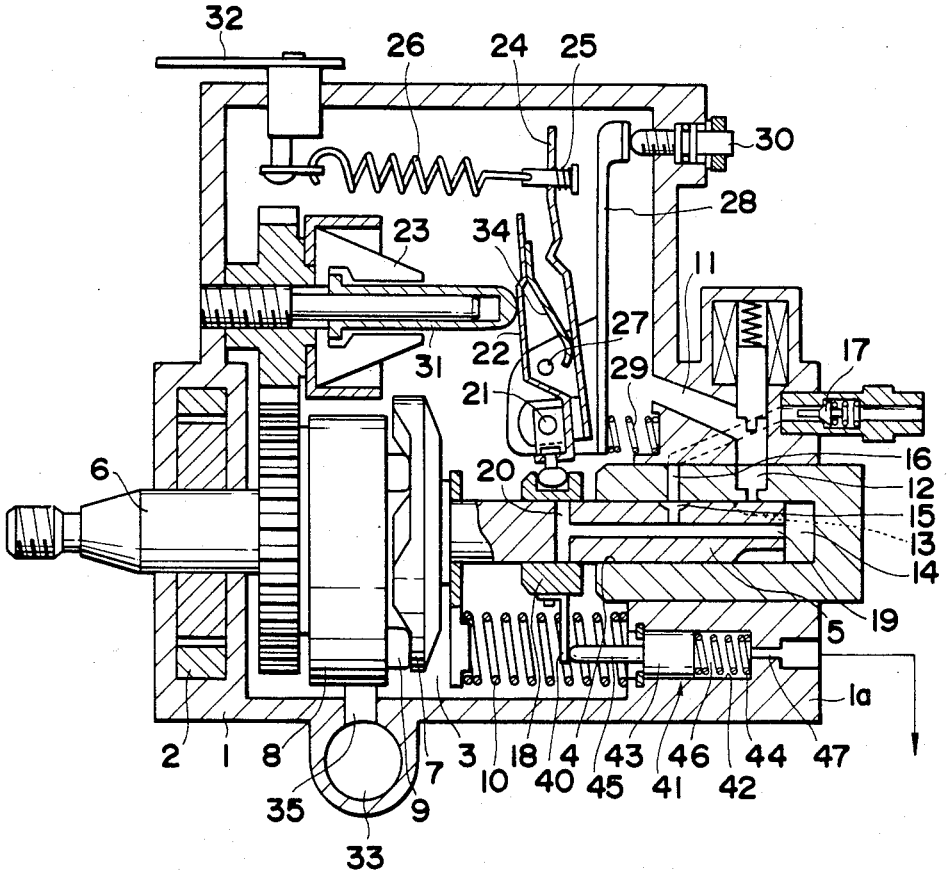
FIG. 1 is a cross sectional view showing an embodiment of this invention.

In FIG. 1, the fuel is supplied to a chamber 3 in a pump housing 1 by means of a fuel feed pump 2 operated by the engine. The internal pressure in the chamber 3 is controlled by a pressure control valve related to the r.p.m. of the engine as is well known so that the internal pressure is proportionally increased with increased r.p.m.

A plunger 5 is slidably mounted in a bore 4 of a plunger barrel provided in the pump housing 1, and this plunger 5 is caused to rotate simultaneous with the reciprocating motion thereof by a means to be described hereinafter.

A drive shaft 6 and a cam disc 7 fixed to a base portion of the plunger 5 are connected by means of a driving disc in the rotating direction, and a cam surface of the cam disc 7 having cam projections corresponding to the number of cylinders of the engine is pressed by a plunger spring 10 against a roller 9 mounted on a roller holder 8, whereby the reciprocating motion for suction and pressure feeding of the fuel by the plunger 5 and the rotation for distribution are carried out simultaneously.

When the plunger 5 is in a suction stroke and moving in a righthand direction in the drawing, the fuel in the chamber 3 is supplied to the pump chamber 14 through a supply path 11 and a suction port 12 and one of a plurality of suction grooves 13 formed in the outer periphery of a head portion of the plunger 4 and extending in the axial direction.

When the plunger 5 is shifted in the pressure feeding stroke, the suction port 12 and the suction groove 13 are separated, and the fuel in the pump chamber 14 is compressed, and is supplied to one of the distribution paths 16, the number of which corresponds to the number of cylinders and which are spaced in the direction of the circumference of bore 4, from a distribution port 15 through an axial bore 19 in the plunger 5, and is sent to an injection nozzle not shown through a feeding valve 17, and is injected into the cylinder.

Also, a control sleeve 18 is slidably fitted on the portion of the plunger 5 which projects into the chamber 3, and when a cutoff port 20 connected with axial bore 19 of the plunger 5 is out from under the control sleeve 18 and is open to the chamber 3, the fuel flows out to the chamber 3, so that the feeding of the fuel to the feeding valve 17 is stopped, and the injection is discontinued. Accordingly, the time of termination of injection is changed by the control of position of the control sleeve 18, namely, the amount of fuel injected can be controlled, and, for example, when the control sleeve 18 is shifted in the lefthand direction in the drawing, the amount of fuel injected is decreased.

An end portion of a start lever 22 the middle portion of which is pivotally supported on a support shaft 21 and has one end engaged with the control sleeve 18, and the lever 22 is displaced in the direction away from an opposed tension lever 24 with the support shaft 21 as a fulcrum by the elastic force of a start spring 34, and the other end of lever 22 is engaged with a sleeve 31 of a centrifugal governor 23 on the side opposite from the tension lever.

A governor spring 26 and an idle spring 25 the spring forces of which are adjusted by a speed lever 32 interlocking with an accelerator in the direction opposite to the direction in which the centrifugal governor 23 works are caused to act on the tension lever 24.

As described in the foregoing, the position of the tension lever 24 is controlled by a balance of the working force of the centrifugal governor 23 and the working force of the governor spring 26, and the position of the control sleeve 18 is adjusted by means of the start lever 22.

Also, the support shaft 21 of the start lever 22 and the tension lever 24 is carried on at the lower end portion of a collector lever 28 pivotally supported on an immobile stationary shaft 27 so as to be rotatable, and the collector lever 28 is urged in a clockwise direction in the drawing by a spring 29 engaged with the lower end portion, and the upper end portion abuts the tip of an adjusting lever 30 (a full load set screw). Accordingly, the position of the collector lever 28 is changed by the adjustment of the position of the adjusting lever in the axial direction to change the position of the support shaft 21, and the amount of fuel injected at the full load can be optionally set.

The roller holder 8 is rotatably mounted concentric with the plunger 5, and is engaged with the piston of an injection timing device 33 to be described hereinbelow by means of a lever 35.

The injection timing device 33 determines the position of the roller holder in the circumferential direction by means of the lever 35 according to the position of the piston not shown in the drawing with respect to the oil pressure. When the position of the roller holder 8 in the circumferential direction is changed, and the contact position of the roller 9 and the cam surface of the cam disc 7 is changed, the phase of the drive shaft 6 in the circumferential direction produces a relative change of the operation position of the plunger 5 according to the contact position and the injection timing can be changed with respect to the rotation of the drive shaft.

The contruction related to this invention comprises an engaging member 40 provided on the control sleeve 18 which projects downwardly, and the engaging member 40 is moved together with the shifting of the control sleeve 18 and the plunger 5.

The engaging member 40 of the control sleeve 18 is engaged with a delay device 41 to be described hereinafter and provided on a distribution head 1*a*, and the shifting of the control sleeve 18 in the fuel increasing direction is controlled by the delay device 41.

The delay device 41 has a piston 43 disposed in a hole 42 extending from the chamber 3 in the distribution head 1*a*, and the piston 43 is urged by a spring 44 toward the chamber, but the pressure in the chamber 3 is applied to the end surface of the piston which is toward the chamber. A push rod 45 is provided at the end of the piston extending into the chamber, and the push rod 45 abuts the engaging member 40 provided on the control sleeve 18. Also, a cylinder 46 behind the piston 43 is connected to the suction side of the fuel feed pump 2 by means of an orifice 47. The force of the spring 44 that applies the pressure to the piston 43 is weaker than the force of the start spring 34. Also, the piston 43 is loosely fitted to the hole 42 so that the fuel in the cylinder 3 flows into the cylinder 46 at the back of the piston 43 through a gap thereon whereby the cylinder 46 is filled with the fuel.

In the foregoing construction, when the engine is rotated, the rotating force is transmitted by means of the drive shaft 6, and the plunger 5 is rotated and reciprocated, and the fuel sucked by the suction port 12 is compressed, and the fuel is sequentially supplied to each fuel injection nozzle from the distribution port 15 to the distribution paths 16, and is injected into cylinders. The amount of the fuel to be injected is determined by the position of the control sleeve 18, and when the control sleeve 18 is moved in the righthand direction in the drawing, the amount of fuel is increased, and when it is moved in the lefthand direction, the amount of fuel is decreased.

When the engine is in the idle condition, and the accelerator pedal is then rapidly stepped on, the control force is transmitted to the tension lever 24 by means of the speed lever 32 and governor spring 26, and the tension lever 24 is rotated in the counterclockwise direction with the support shaft 21 as a fulcrum. Accordingly, the control sleeve 18 has applied thereto a force for shifting it in the fuel increasing direction (righthand direction in the drawing) but the motion of the control sleeve 18 is delayed by the delay device 41.

Figure 2:
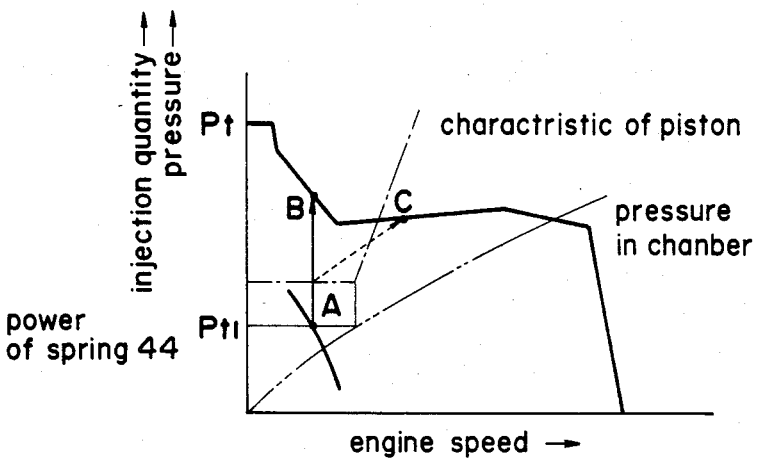
FIG. 2 is a graph showing the characteristic of the conventional device and a characteristic of this invention.

Namely, when the force is applied to the piston 43, the pressure is applied to the fuel which has leaked through the gap between the piston 43 and hole 42 and fills the cylinder 46 at the back thereof, and the amount of fuel flowing out from the cylinder 46 is limited to the amount which can be passed through the gap so that the shifting speed of the piston 43 is subjected to this limitation, and the motion of the control sleeve 18 is delayed, and as the rotation of the engine is increased during the delay time, the shifting from A to C in FIG. 2 takes place as far as the characteristic at the time of control condition is concerned where there is no characteristic the excess fuel starting device and thus, the generation of the smoke due to the excessive amount of the fuel can be prevented.

When the diameter of the orifice 47 is properly changed, needless to say, the characteristic can be properly changed to the desired delay characteristic.

When the r.p.m. of the engine reaches a medium speed zone (for example, above 1000 r.p.m.) from a low speed zone, the pressure Pt in the chamber 3 is elevated accordingly, and as a result, it becomes the pressure Pt1 corresponding to the set force of the spring 44, and the piston 43 of the delay device 41 is caused to retreat rapidly against the resistance of the spring 44. Namely, in the zone from the medium speed to a high speed zone, the piston 43 is retracted and no influence is applied to the shifting of the control sleeve 18 of the delay device 41, and it thus supplies the normal operating feeling to the driver.

At the start time, there is an influence by the delay device 41, and the shifting of the control sleeve is delayed, but the characteristic an excess fuel starting device can be obtained.

Figure 3:
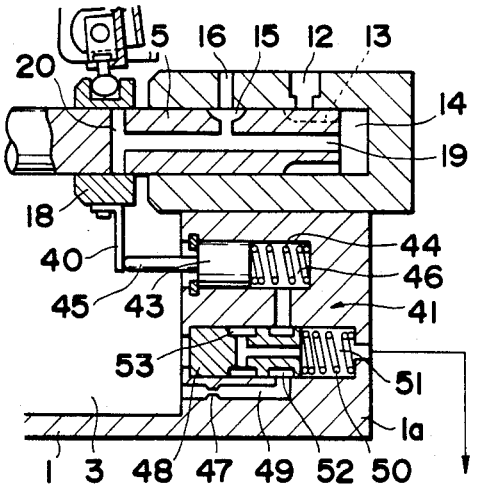
FIG. 3 is a cross sectional view of an essential part according to another embodiment of this invention.

In FIG. 3, another embodiment of this invention is illustrated. In this embodiment, the structure differs from the foregoing embodiment in that the displacement of the piston 43 provided with the push rod 45 of the delay device 41, namely, the effective end pressure (r.p.m.) of the delay device is controlled by a servo piston 48, whereby the spring 44 that urges the piston 43 can be changed to a spring having a weak force as compared with the start spring 34, and as a result, the influence of the delay device with respect to the shifting of the control sleeve 18 at the start time can be minimized.

Next, the construction of this invention will be described, in which the chamber 46 behind the piston 43 of the delay device is communicated with the inside of the chamber 3 by means of a path 49, and the orifice 47 is provided in the path 49. The servo piston 48 is provided in the path 49, and the servo piston 48 is urged by a cancel spring 50, and is toward the chamber 3, and the inner pressure of the chamber is applied to the end surface of the servo piston from the chamber.

The servo piston 49 is provided with an annular groove 53 communicating with annular groove 52 and a cylinder 51 at the back of the servo piston, and at the low speed of rotation of the engine, the cancel spring 50 overcomes the pressure in the chamber 3, and the path 49 is opened and the cylinder 46 at the back of the piston 43 is communicated with the inside of the chamber 3.

When the rapid acceleration is carried out during at the idle time at low speed rotation, the control sleeve 18 has applied thereto for the force shifting in the direction of increasing the amount of fuel, but the shifting speed is controlled by the delay device 41.

Namely, as the fuel filling the chamber 46 at the back of the piston 43 flows out into the chamber 3 through the orifice 47 and the shifting of the piston 43 is limited, the shifting speed of the control sleeve 18 is properly delayed.

When the engine enters the medium speed zone (for example, above 1000 r.p.m.), the pressure in the chamber 3 is increased, and when the pressure exceeds the pressure Pt1, the cancel spring 50 of the servo piston 48 yields to the pressure in the chamber 3, and the servo piston 48 is retracted, and as a result, the cylinder 46 at the back of the piston 43 is communicated with the low pressure side, that is the suction side of the fuel feed pump 2, and the piston 43 is retracted rapidly by the pressure in the chamber 3, and the delay device 41 does not have any influence on the shifting of the control sleeve 18.

The remaining components are the same as those in the first embodiment are given identical reference numbers and the description thereof is omitted.

What is claimed is:

1. In a distribution type fuel injection pump means having:

a fuel feed pump, a chamber to which fuel is supplied by said fuel feed pump and in which the fuel pressure is according to the engine r.p.m., a plunger which reciprocates and rotates simultaneously and carries out suction and subsequent pressure feeding of the fuel from said chamber and distributes it, said plunger having a cutoff port opening out of said plunger, a control sleeve shiftably mounted on said plunger for sliding movement therealong to cover and uncover said cutoff port for changing the time of opening the cutoff port for increasing or decreasing the amount of fuel fed, and regulating means connected to said control sleeve for adjusting the position of said control sleeve according to the engine r.p.m. and the accelerator position for providing a predetermined excess fuel starting characteristic, the improvement comprising:

an engaging member on said control sleeve; and a delay means on said pump means abuttable by said engaging member when said control sleeve is moved in the direction for increasing the fuel pumped by said plunger for delaying the shifting of said control sleeve in said fuel increasing direction.

2. The improvement as claimed in claim 1 in which said delay means is a piston and a cylinder in which said piston is slidable, the end of said piston having a sleeve engaging means engageable with said control sleeve and said one end of said piston being exposed to the interior of said chamber, and the cylinder behind said piston having a passage extending therefrom and communicated with a low presure means, and said passage having an orifice therein for restricting flow therethrough.

3. The improvement as claimed in claim 2 in which said cylinder is in the wall of said chamber and said sleeve engaging means is a push rod on said piston, and said delay means further comprises a spring in said cylinder urging said piston toward said chamber.

4. The improvement as claimed in claim 3 in which said piston is fitted loosely in said cylinder, whereby the fuel in the chamber flows into the cylinder behind said piston and fills said cylinder.

5. The improvement as claimed in claim 1 in which said delay means comprises a piston and a cylinder in which said piston is slidable, the end of the piston having a sleeve engaging means engageable with said control sleeve and said one end of said piston being exposed to the interior of said chamber, and the cylinder behind said piston having a passage extending therefrom and branched to said chamber and to a low pressure means, and a servo piston in said passage and exposed to the interior of said chamber for controlling said passage to connect it to either the chamber or said low pressure means.

6. The improvement as claimed in claim 5 in which said cylinder is in the wall of said chamber and said sleeve engaging means is a push rod on said piston, and said delay means further comprises a spring in said cylinder urging said piston toward said chamber.

7. The improvement as claimed in claim 6 in which said piston is fitted loosely in said cylinder, whereby the fuel in the chamber flows into the cylinder behind said piston and fills said cylinder.

8. The improvement as claimed in claim 5 in which said servo piston is in a servo cylinder in the wall of said chamber having one end open to said chamber, and a further spring in the other end of said servo cylinder urging said servo piston toward said chamber, said servo piston having grooves and a bore therein for, in one position of said servo piston, placing said passage from said firstmentioned cylinder in communication with said low pressure source and in a second position placing said passage in communication with the interior of said chamber.

* * * * *